US007721403B2

(12) United States Patent
Huang et al.

(10) Patent No.: US 7,721,403 B2
(45) Date of Patent: May 25, 2010

(54) MANUFACTURING METHOD FOR A GOLF CLUB HEAD

(75) Inventors: Chun-Yung Huang, Kaohsiung Hsien (TW); Chan-Tung Chen, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 337 days.

(21) Appl. No.: 11/434,805

(22) Filed: May 17, 2006

(65) Prior Publication Data

US 2006/0205531 A1 Sep. 14, 2006

Related U.S. Application Data

(60) Continuation of application No. 11/118,356, filed on May 2, 2005, now abandoned, which is a division of application No. 10/725,544, filed on Dec. 3, 2003, now abandoned.

(51) Int. Cl.
*B23P 11/00* (2006.01)
*A63B 53/04* (2006.01)
*B23K 20/12* (2006.01)

(52) U.S. Cl. ..... 29/458; 29/525.14; 29/527.2; 29/530; 473/305; 473/349; 228/112.1; 228/114.5

(58) Field of Classification Search ..... 29/458, 29/525.14, 527.2, 530; 473/305, 306, 307, 473/308, 309, 310, 335, 338, 349; 228/112.1, 228/114.5, 165

See application file for complete search history.

(56) References Cited

U.S. PATENT DOCUMENTS

| | | | | |
|---|---|---|---|---|
| 5,064,112 A | | 11/1991 | Isobe et al. | |
| 5,505,795 A | * | 4/1996 | Tsai et al. | 148/527 |
| 5,542,664 A | * | 8/1996 | Mahaffey et al. | 473/305 |
| 5,669,825 A | | 9/1997 | Shira | |
| 5,769,307 A | | 6/1998 | Takeda | |
| 5,885,170 A | | 3/1999 | Takeda | |

FOREIGN PATENT DOCUMENTS

JP 2003-25075 1/2003

* cited by examiner

*Primary Examiner*—Jermie E Cozart
(74) *Attorney, Agent, or Firm*—Muncy, Geissler, Olds & Lowe, PLLC

(57) ABSTRACT

A golf club head includes a first portion forming a part of the head body of the golf club head, a second portion forming another part of the head body of the golf club head, and an intermediate layer. The first portion, the second portion, and the intermediate layer are made of different materials. Each of the first portion and the second portion has an abutting portion, with the intermediate layer being positioned between the abutting portion of the first portion and the abutting portion of the second portion. The intermediate layer and the abutting portion of the first portion are joined together by friction welding, and the intermediate layer and the abutting portion of the second portion are joined together by friction welding, thereby forming a golf club head product.

15 Claims, 8 Drawing Sheets

MANUFACTURING METHOD FOR A GOLF CLUB HEAD

This application is a Continuation of co-pending Application Ser. No. 11/118,356, filed on May 2, 2005, now abandoned which is a Divisional of Application Ser. No. 10/725,544, filed on Dec. 3, 2003 and now abandoned, and for which priority is claimed under 35 U.S.C. § 120; the entire contents of which are hereby incorporated by reference.

BACKGROUND OF THE INVENTION

1. Field of the Invention

The present invention relates to a golf club head. In particular, the present invention relates to a golf club head that is produced by means of joining two portions of the golf club head by friction welding.

2. Description of Related Art

A typical golf club head and a production method therefore are disclosed in, e.g., U.S. Pat. Nos. 5,769,307 and 5,885,170. As illustrated in FIGS. 1 and 2 of the drawings which respectively correspond to FIGS. 1 and 2 of U.S. Pat. Nos. 5,769,307 and 5,885,170, a typical golf club includes a head body 10, a hosel 20, and a shaft 30. The head body 10 is made of a metal material and includes a striking plate 11 on a front side thereof, with a heel 12 being formed on a side of the striking plate 11, and with an extension 13 extending upward from the heel 12 and having a flat abutting portion 131. Another flat abutting portion 22 is formed at a lower part of the hosel 20 that is formed of another metal material. The hosel 20 includes an engaging hole 21 in an upper part thereof for engaging with a lower end of a shaft 30.

A force F is applied to the head body 10 and the hosel 20 to make the flat abutting portion 131 abuts against the flat abutting portion 22. Then, the flat abutting portion 131 (or the flat abutting portion 22) is turned relative to the flat abutting portion 22 (or the flat abutting portion 131). With the friction heat, the head body 10 can be joined to the hosel 20.

Although the friction welding simplifies the manufacturing process and cuts the manufacturing cost in comparison to ordinary welding or brazing, several problems exist. Firstly, the metal material of the flat abutting portion 131 and the metal material of the flat abutting portion 22 melt and fuse with each other after friction welding, forming an intermetallic layer (not shown). Since the metal material (e.g., stainless steel) of the flat abutting portion 131 differs from that (e.g., titanium alloy) of the flat abutting portion 22 and thus provides poor compatibility in welding, the metallurgic structure of the intermetallic layer is detrimental to improvement of the bonding strength, resulting in a fragile structure or reducing the resilient deforming capability. As a result, the connection area between the head body 10 and the hosel 20 may break when proceeding with adjusting of inclination angle A of the hosel 20 of the golf club head product or when striking a golf ball. The good product ratio is reduced, and the life of the club head is shortened. Results of cannon shot tests showed that the head body 10 and the hosel 20 were apt to crack or break after being shot not more than 1000 times (a golf ball with a standard weight hits the striking plate 11 of the head body 10 at a velocity of 50 m/sec). The same problem exists when using friction welding to bond two portions of the club head that are made of different metals having insufficient compatibility.

OBJECTS OF THE INVENTION

An object of the present invention is to provide an intermediate layer for joining two portions of a golf club head by friction welding, providing improved joining reliability, improving good product ratio, and prolonging the life of the golf club head product.

Another object of the present invention is to provide an intermediate layer for joining a head body and a hosel of a golf club head by friction welding, providing improved joining reliability for the hosel, improving adjusting range of the inclination angle of the hosel, and prolonging the life of the golf club head product.

A further object of the present invention is to provide an intermediate layer for joining a head body and a weight member of a golf club head by friction welding, providing improved joining reliability for the weight member.

SUMMARY OF THE INVENTION

In accordance with an aspect of the present invention, a golf club head includes a first portion forming a part of a head body of the golf club head, a second portion forming another part of the head body of the golf club head, and an intermediate layer. The first portion, the second portion, and the intermediate layer are made of different materials. Each of the first portion and the second portion has an abutting portion, with the intermediate layer being positioned between the abutting portion of the first portion and the abutting portion of the second portion. The intermediate layer and the abutting portion of the first portion are joined together by welding friction, and the intermediate layer and the abutting portion of the second portion are joined together by friction welding, thereby forming a golf club head product.

The metallurgical compatibility between the first metal material and the third metal material is better than that between the first metal material and the second metal material, and the metallurgical compatibility between the second metal material and the third metal material is better than that between the first metal material and the second metal material.

In an embodiment of the invention, the first portion is a head body, and the second portion is a hosel. The bonding strength and bonding reliability of the golf club head product are improved by the intermediate layer. Further, subsequent adjustment of the inclination angle of the hosel is convenient, and the life of the golf club head product is prolonged. In another embodiment of the invention, the first portion is a head body, and the second portion is a weight member.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
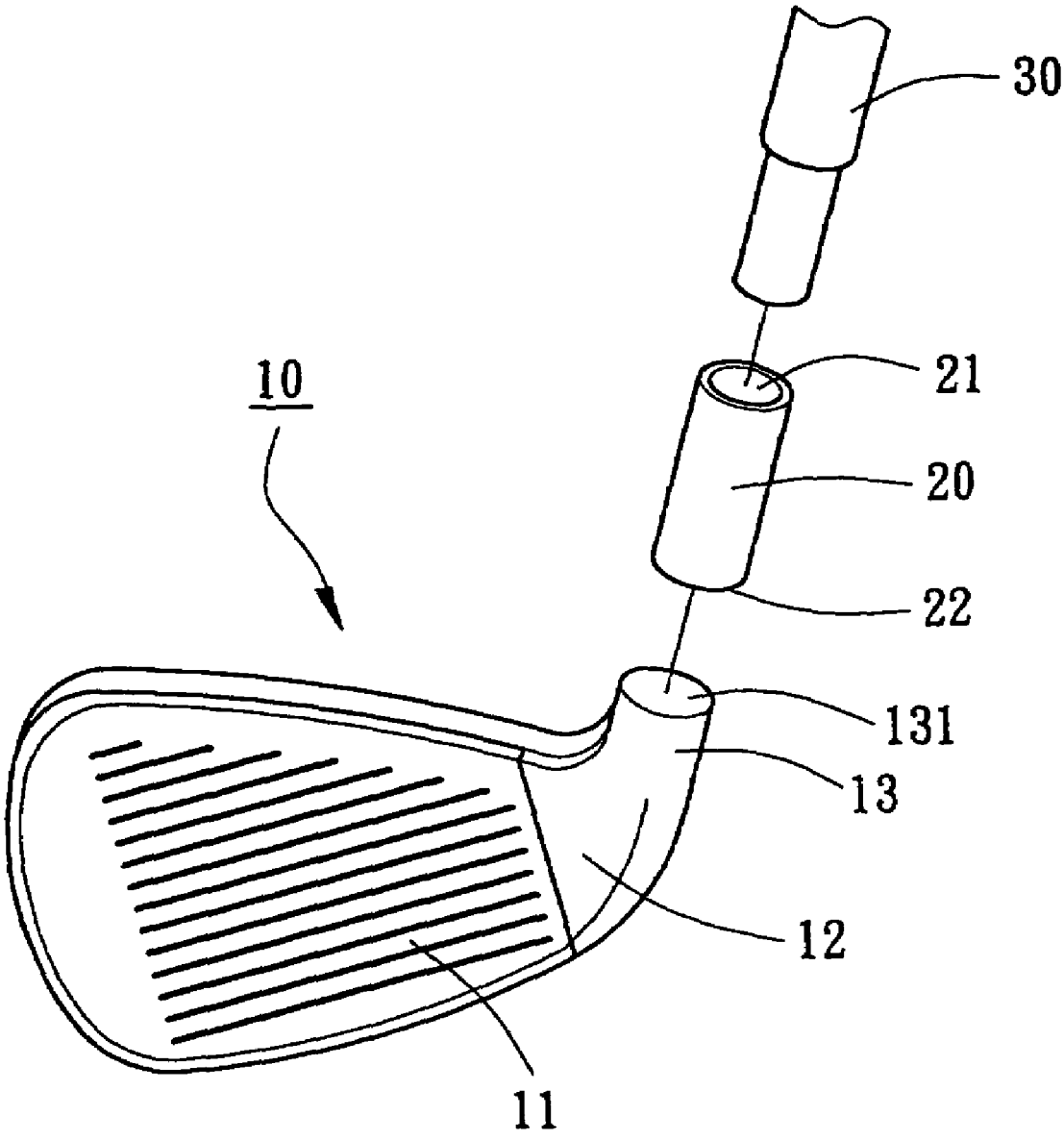
FIG. 1 PRIOR ART
FIG. 1 is an exploded perspective view of a conventional golf club head.
Figure 2:
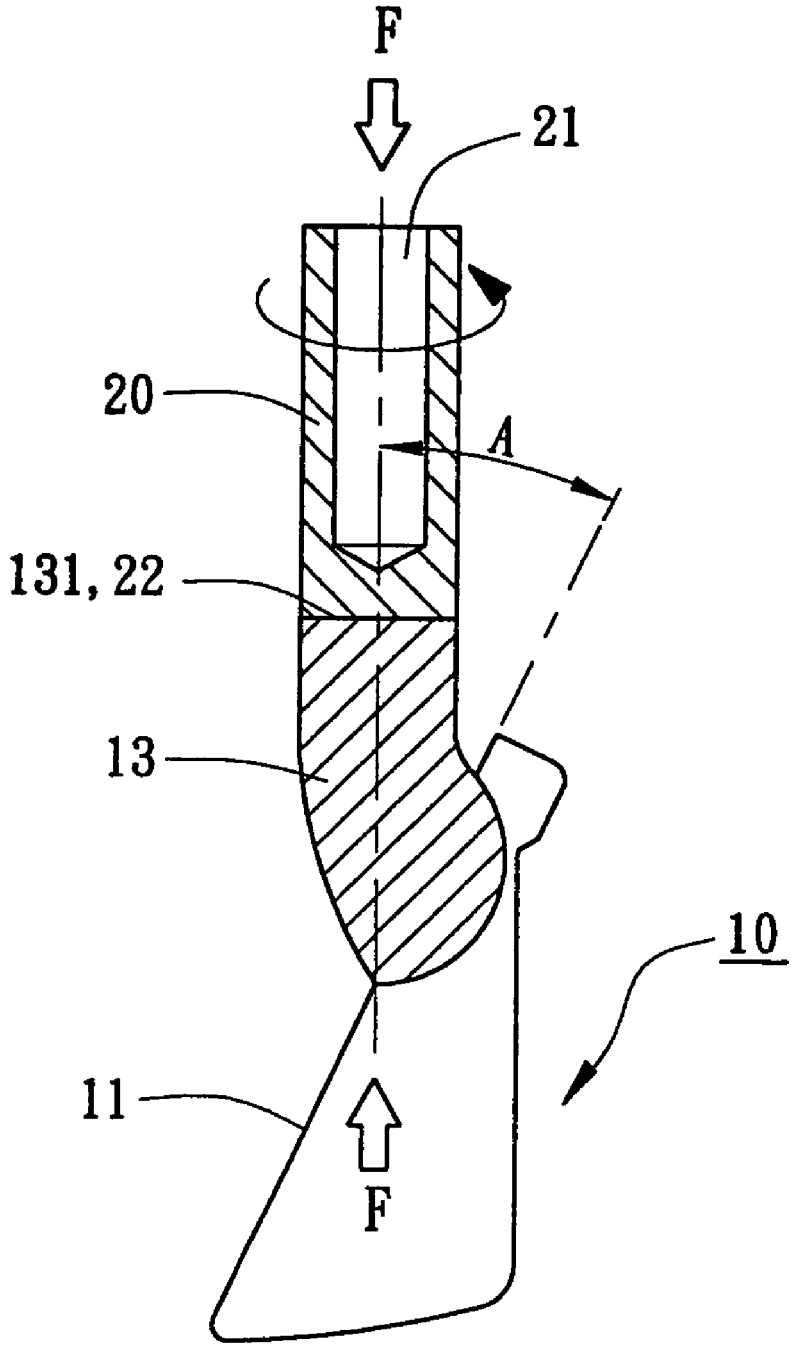
FIG. 2 PRIOR ART
FIG. 2 is a sectional view illustrating formation of the conventional golf club head by friction welding.

Preferred embodiments of the present invention are now to be described hereinafter in detail, in which the same reference numerals are used in the preferred embodiments for the same parts as those in the prior art to avoid redundant description.

Figure 3:
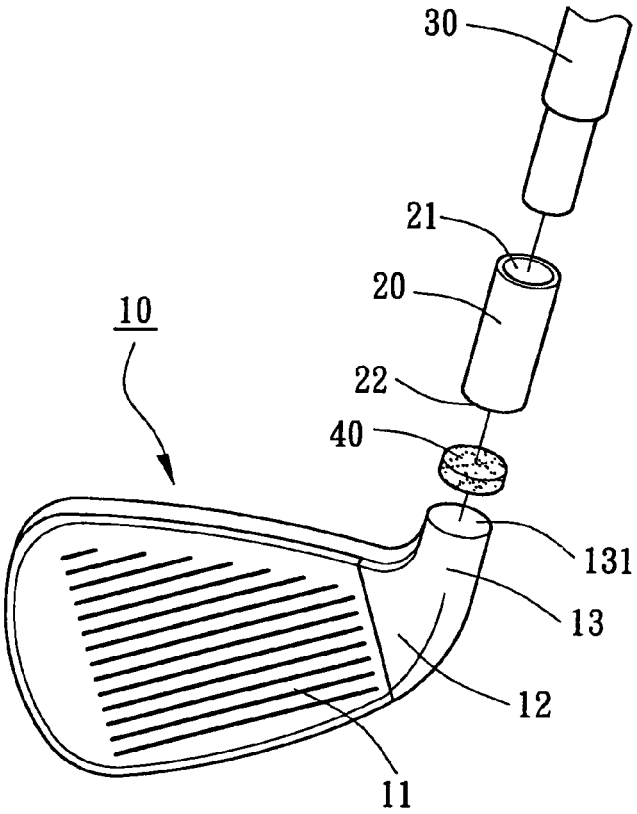
FIG. 3 is an exploded perspective view of a first embodiment of a golf club head in accordance with the present invention.

Referring to FIG. 3, a first embodiment of a golf club head in accordance with the present invention includes a first portion, a second portion, and an intermediate layer 40. In this embodiment, the first portion is a head body 10 made of a first metal material. A string plate 11 is formed on a front side of the head body 10 for striking a golf ball. A heel 12 is formed on a side of the striking plate 11, with an extension 13 extending upward from the heel 12 and having an abutting portion 131.

The second portion is a hosel 20 having an engaging hole 21 in an upper part thereof for engaging with a shaft 30. The hosel 20 further includes an abutting portion 22 formed at a lower part thereof. The hosel 20 is made of a second metal material. The intermediate layer 40 is made of a third metal material. The first metal material, the second metal material, and the third metal material are different from one another. The metallurgical compatibility between the first metal material and the third metal material is better than that between the first metal material and the second metal material. Further, the metallurgical compatibility between the second metal material and the third metal material is better than that between the first metal material and the second metal material. Given that the first metal material is different from the second metal material, each of the first metal material and the second metal material is selected from the group consisting of stainless steel, titanium alloy, carbon steel, low-alloy steel, cast iron, nickel-base alloy, structural steel, Fe—Mn—Al alloy, and super alloy. The third metal material is selected from the group consisting of niobium (Nb), chromium (Cr), aluminum (Al), iron (Fe), zirconium (Zr), titanium (Ti), vanadium (V), tantalum (Ta), silver (Ag), nickel (Ni), tungsten (W), and alloys thereof. The shaft 30 can be made of other metal material or a non-metal material, such as carbon fiber composite material.

Figure 4:
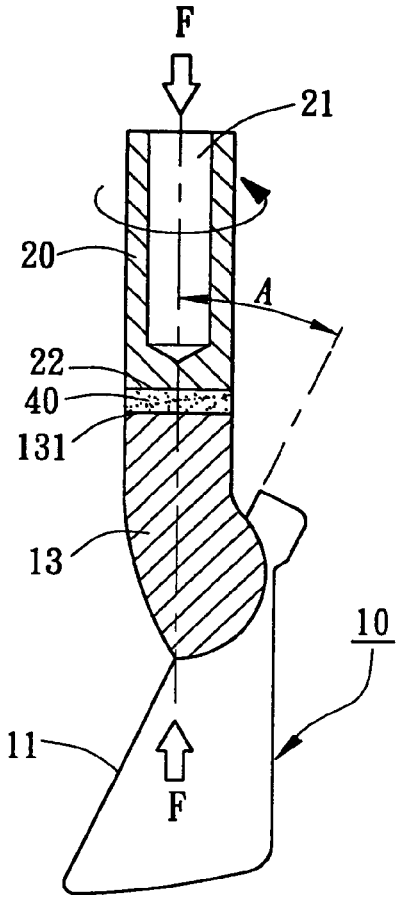
FIG. 4 is a sectional view illustrating formation of the golf club head in FIG. 3 by friction welding.
Figure 5:
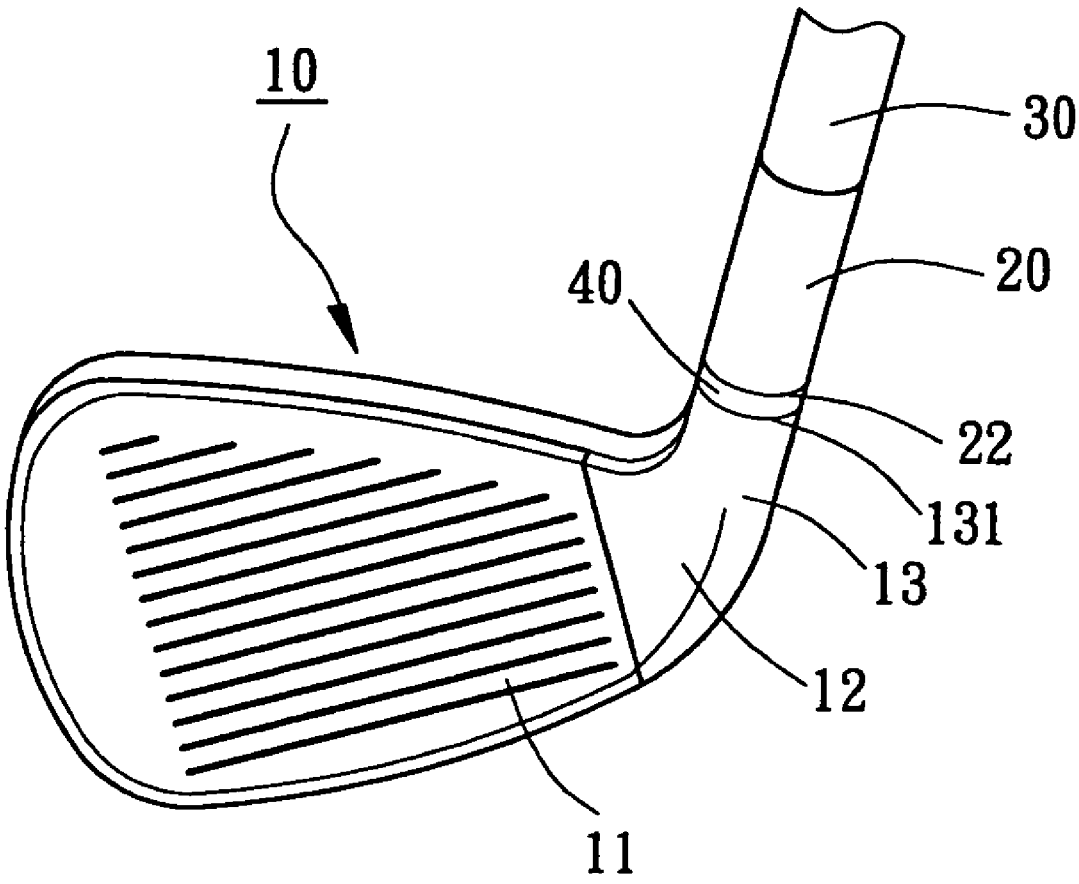
FIG. 5 is a perspective view of the golf club head in FIG. 3.

Referring to FIGS. 4 and 5, the head body 10 (the first portion), the intermediate layer 40, and the hosel 20 (the second portion) are joined together by friction welding. In assembly, a force F is applied to the head body 10 and the hosel 20 to make the abutting portion 131 of the head body 10, the intermediate layer 40, and the abutting portion 22 of the hosel 20 abut against each other in sequence. Then, the abutting portion 131 is turned relative to the abutting portion 22 and the intermediate layer 40. With the friction heat, the abutting portion 131 is joined to the intermediate layer 40.

Next, the abutting portion 22 (or the combination of the abutting portion 131 and the intermediate layer 40) is turned relative to the combination of the abutting portion 131 and the intermediate layer 40 (or the abutting portion 20). With the friction heat, the abutting portion 22 is joined to the combination of the abutting portion 131 and the intermediate layer 40. Thus, the head body 10, the intermediate layer 40, and the hosel 20 are joined together. A golf club head product is obtained after removal of residuals.

Referring to FIG. 4, since the intermediate layer 40 is made of a third material having a better welding compatibility with the abutting portion 131 made of the first material and the abutting portion 22 is made of the second material, the bonding strength of the two abutting portions 131 and 22 is improved via provision of the intermediate layer 40 between the abutting portions 131 and 22. Results of cannon shot tests showed that the head body 10 and the hosel 20 neither cracked nor broke after being shot not more than 1000 times (a golf ball with a standard weight hits the striking plate 11 of the head body 10 at a velocity of 50 m/sec). The bonding strength and bonding reliability of the golf club head product are improved by the intermediate layer 40. Further, subsequent adjustment of the inclination angle A of the hosel 20 is convenient, and the life of the golf club head product is prolonged.

The intermediate layer 40 can be formed in the shape of a tablet in advance. Alternatively, the intermediate layer 40 can be powdery or pasty or can be provided on the abutting portion 131 and/or the abutting portion 22 by electroplating or spraying. Further, the surface roughness of the abutting portion 131 and/or the abutting portion 22 is smaller than Ra 25 μm, preferably smaller than Ra 6.3 μm, and most preferably smaller than Ra 1.6 μm. By this arrangement, when the abutting portion 131 and/or the abutting portion 22 abuts against the upper side of the intermediate layer 40 and/or the lower side of the intermediate layer 40, the oxidized layer (not shown) on the contacting area is scraped by the surface roughness. Thus, adverse effects to the bonding strength and bonding reliability by the oxidized layer is avoided.

Figure 6:
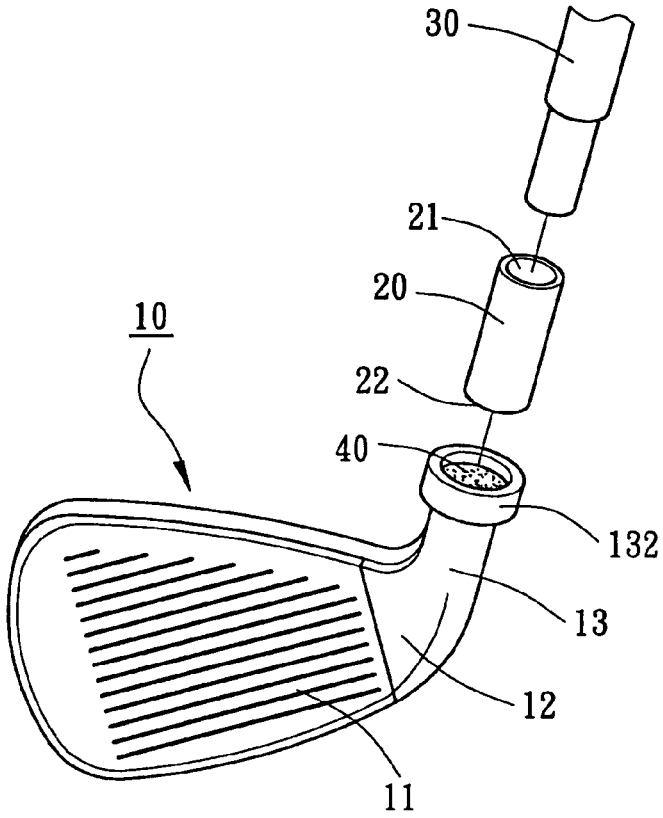
FIG. 6 is an exploded perspective view of a second embodiment of the golf club head in accordance with the present invention.
Figure 7:
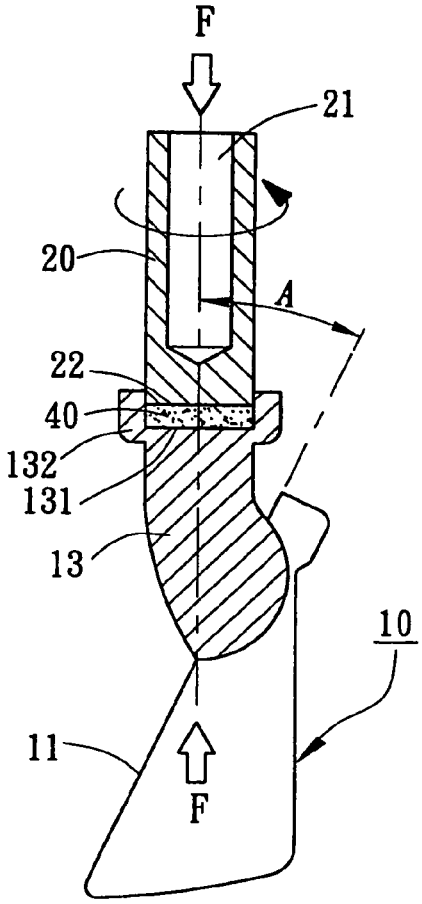
FIG. 7 is a sectional view illustrating formation of the golf club head in FIG. 6 by friction welding.

FIGS. 6 and 7 illustrate a second embodiment of the present invention, wherein the abutting portion 131 of the head body 10 (the first portion) includes an annular wall 132 delimiting a space (not labeled) for receiving the intermediate layer 40 that is tablet-like, powdery, or pasty. Alternatively, the intermediate layer 40 is provided by electroplating or spraying. The annular wall 132 allows precise alignment between the head body 10 (the first portion), the intermediate layer 40, and the hosel 20 (the second portion). After friction welding, the annular wall 132 can be kept or removed by proper surface finishing, providing a golf club head product (see FIG. 5).

Figure 8:
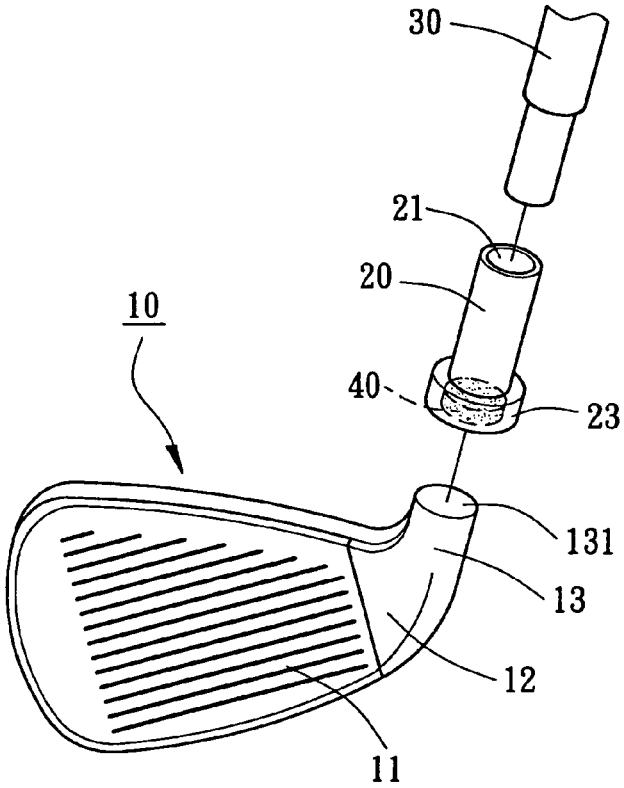
FIG. 8 is an exploded perspective view of a third embodiment of the golf club head in accordance with the present invention.
Figure 9:
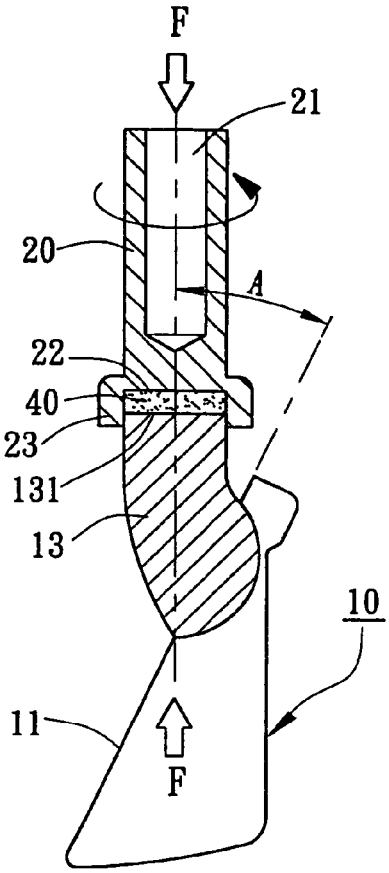
FIG. 9 is a sectional view illustrating formation of the golf club head in FIG. 8 by friction welding.

FIGS. 8 and 9 illustrate a third embodiment of the present invention, wherein the abutting portion 22 of the hosel 20 (the second portion) includes an annular wall 23 delimiting a space (not labeled) for receiving the intermediate layer 40 that is tablet-like or pasty. Alternatively, the intermediate layer 40 is provided by electroplating or spraying. The annular wall 23 allows precise alignment between the head body 10 (the first portion), the intermediate layer 40, and the hosel 20 (the second portion). After friction welding, the annular wall 23 can be kept or removed by proper surface finishing, providing a golf club head product (see FIG. 5).

Figure 10:
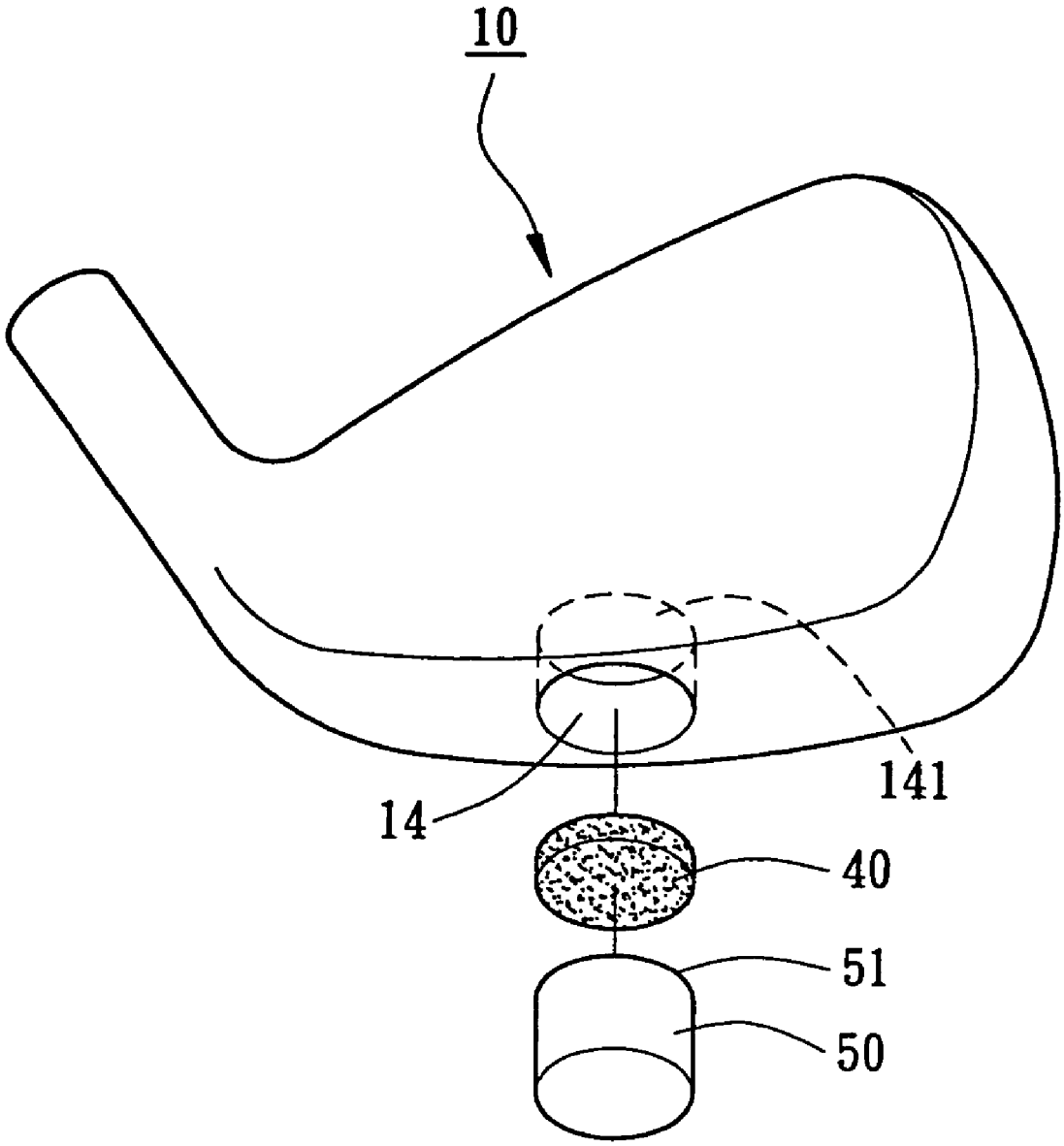
FIG. 10 is an exploded perspective view of a fourth embodiment of the golf club head in accordance with the present invention.
Figure 11:
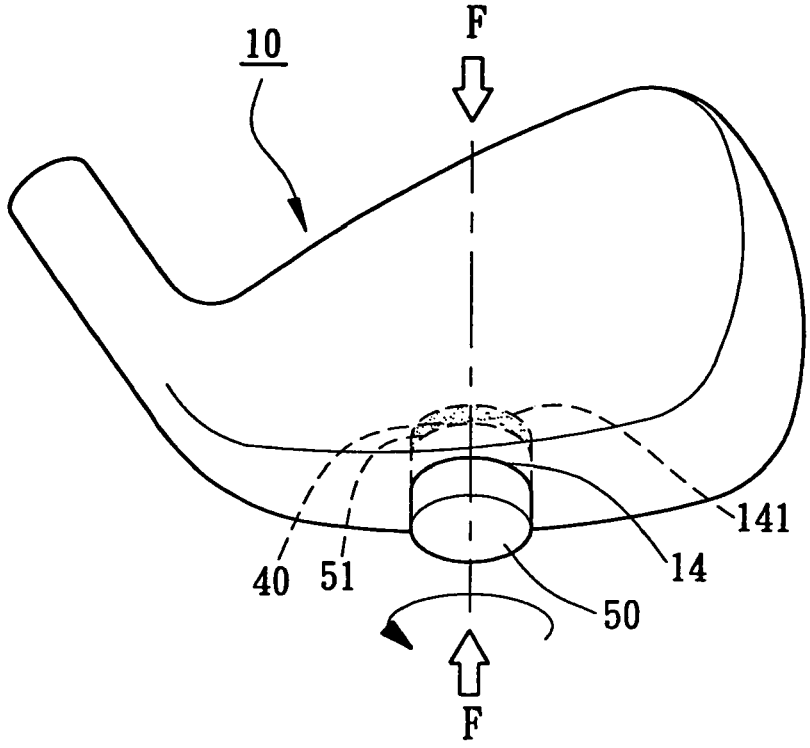
FIG. 11 is a perspective view illustrating formation of the golf club head in FIG. 10 by friction welding.
Figure 12:
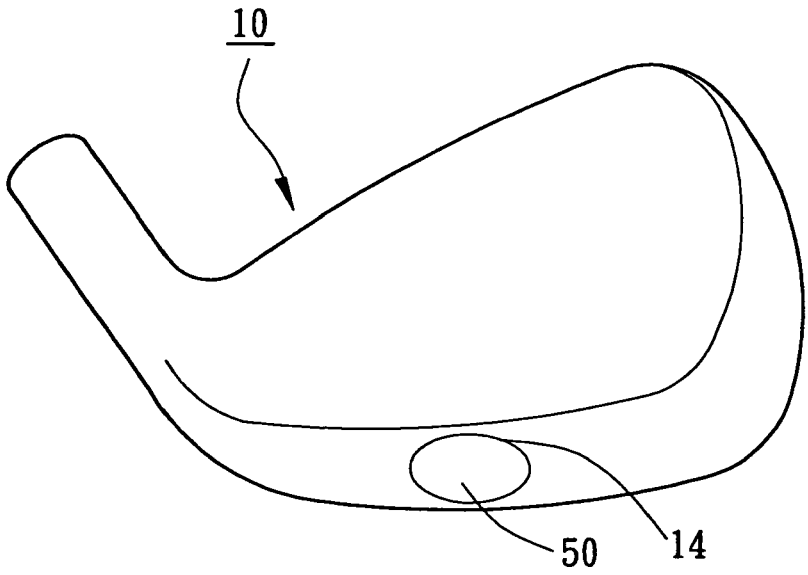
FIG. 12 is a perspective view of the golf club head in FIG. 10.

FIGS. 10 through 12 illustrate a fourth embodiment of the present invention, wherein the intermediate layer 40 is used to join the head body 10 (the first portion) and a weight member 50 (the second portion). The head body 10 includes a compartment 14 in an appropriate portion thereof (such as the bottom side of the head body 10). A bottom wall delimiting the compartment 14 forms an abutting portion 141, and the weight member 50 includes an abutting portion 51 on a side thereof. The intermediate layer 40 is tablet-like, powdery, or pasty. Alternatively, the intermediate layer 40 is provided on the abutting portion 141 of the compartment 14 by electroplating or spraying.

The head body 10 and the weight member 50 are joined together via the intermediate layer 40 by friction welding under the condition of applying a force F to the head body 10 and the weight member 50. A golf club head product (see FIG. 12) is obtained after removal of residuals on the weight member 50. In this embodiment, the first metal material is selected from the group consisting of stainless steel, carbon steel, titanium alloy, low-alloy steel, cast iron, nickel-base alloy, structural steel, Fe—Mn—Al alloy, and super alloy. The second metal material is a material having a specific density greater than 7.6 g/cm$^3$ and selected from the group consisting of W—Fe—Ni alloy, tungsten alloy, molybdenum (Mo) alloy, and copper alloy. The material for the intermediate layer 40 is selected from the group consisting of niobium (Nb), chromium (Cr), aluminum (Al), iron (Fe), zirconium (Zr), titanium (Ti), vanadium (V), tantalum (Ta), silver (Ag), nickel (Ni), tungsten (W), and alloys thereof.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A manufacturing method for a golf club head comprising the steps of:

providing a first abutting portion on a first portion of the golf club head, and a second abutting portion on a second portion of the golf club head, the first and second portions being made of first and second metal materials respectively;

forming an annular wall on one of the first and second abutting portions;

disposing an intermediate layer within the annular wall, the intermediate layer being made of a third metal material; and joining the first and second abutting portions by friction welding.

2. The manufacturing method as claimed in claim 1, further comprising the step of removing the annular wall after the friction welding.

3. The manufacturing method as claimed in claim 1, wherein the first abutting portion is formed on an extension extending from a heel of the head body, and wherein the second abutting portion is formed on a hosel.

4. The manufacturing method as claimed in claim 3, wherein the first abutting portion of the extension includes the annular wall for receiving the intermediate layer before friction welding.

5. The manufacturing method as claimed in claim 3, wherein the second abutting portion of the hosel includes the annular wall for receiving the intermediate layer before friction welding.

6. The manufacturing method as claimed in claim 1, wherein the first abutting portion is located in the annular wall delimiting a compartment of the head body, and wherein the second abutting portion is formed on a weight member.

7. The manufacturing method as claimed in claim 1, wherein the first metal material, the second metal material, and the third metal material are different from one another, a metallurgical compatibility between the first metal material and the third metal material being better than that between the first metal material and the second metal material, and a metallurgical compatibility between the second metal material and the third metal material being better than that between the first metal material and the second metal material.

8. The manufacturing method as claimed in claim 7, wherein the first metal material is selected from the group consisting of stainless steel, titanium alloy, carbon steel, low-alloy steel, cast iron, nickel-base alloy, structural steel, Fe—Mn—Al alloy, and super alloy.

9. The manufacturing method as claimed in claim 7, wherein the second metal material is selected from the group consisting of stainless steel, titanium alloy, carbon steel, low-alloy steel, cast iron, nickel-base alloy, structural steel, Fe—Mn—Al alloy, and super alloy.

10. The manufacturing method as claimed in claim 7, wherein the third metal material is selected from the group consisting of niobium, chromium, aluminum, iron, zirconium, titanium, vanadium, tantalum, silver, nickel, tungsten, and alloys thereof.

11. The manufacturing method as claimed in claim 1, wherein the intermediate layer is tablet-like, powdery, or pasty.

12. The manufacturing method as claimed in claim 1, further comprising the step of forming the intermediate layer on one of the first abutting portion of the first portion and the second abutting portion of the second portion by one of electroplating and spraying before friction welding.

13. The manufacturing method as claimed in claim 1, further comprising the step of processing one of the first and second abutting portions to have a surface roughness smaller than Ra 25 μm.

14. The manufacturing method as claimed in claim 1, wherein the intermediate layer has a generally circular disc shape.

15. The manufacturing method as claimed in claim 1, wherein the golf club head has a shaft with a longitudinal axis and wherein the intermediate layer is intersected by the longitudinal axis of the shaft.

* * * * *